United States Patent [19]

Czaplinski et al.

[11] 4,020,355

[45] Apr. 26, 1977

[54] RECEPTACLE FOR RADIOACTIVE MATERIAL

[75] Inventors: Thomas V. Czaplinski, North Brunswick; Thomas Albert Haney, East Brunswick, both of N.J.

[73] Assignee: E. R. Squibb & Sons, Inc., Princeton, N.J.

[22] Filed: June 30, 1975

[21] Appl. No.: 591,990

Related U.S. Application Data

[63] Continuation-in-part of Ser. No. 333,095, Feb. 16, 1973, abandoned.

[52] U.S. Cl. ..... 250/506

[51] Int. Cl.[2] ..... G21F 5/00

[58] Field of Search ..... 250/506

[56] References Cited

UNITED STATES PATENTS

| | | | |
|---|---|---|---|
| 3,655,985 | 4/1972 | Brown et al. | 250/506 |
| 3,673,411 | 6/1972 | Glasser | 250/506 |

*Primary Examiner*—Davis L. Willis
*Attorney, Agent, or Firm*—Lawrence S. Levinson; Merle J. Smith; John J. Archer

[57] ABSTRACT

A receptacle for storing radioactive material includes three concentric cylindrical casings of radiation shielding material, a container of radioactive material being received within the innermost casing, and a cover member or members forming a closure for the casingswhich are open at the top. Two of the casings and the cover member or members are of non-transparent radiation shielding material, such as lead, and the third casing is of transparent radiation shielding material, such as leaded glass. One of the non-transparent casings is movable with respect to the other non-transparent casing so that windows in each of the non-transparent casings can be aligned by the relative movement therebetween to permit the viewing of the material level within the container.

11 Claims, 5 Drawing Figures

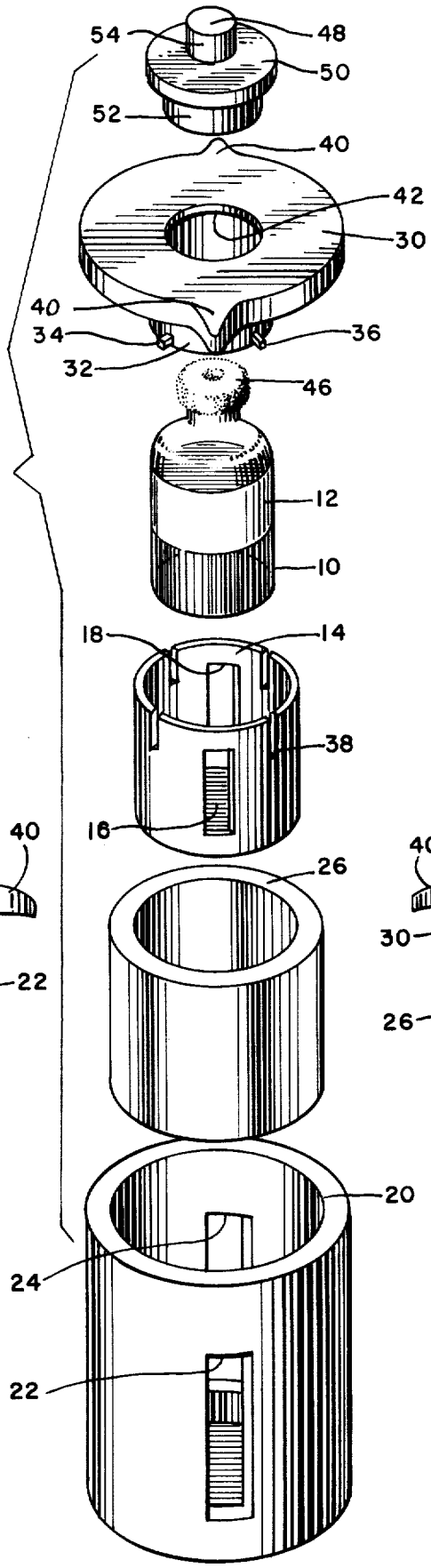
FIG. 1
FIG. 2
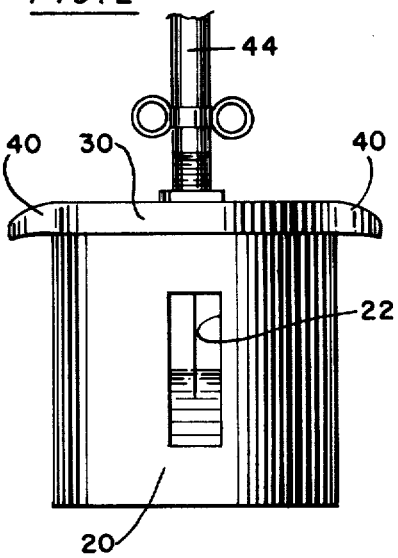
FIG. 3
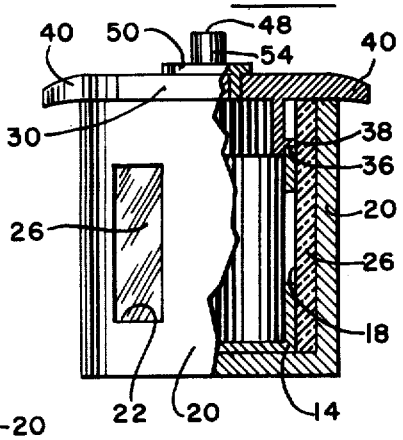

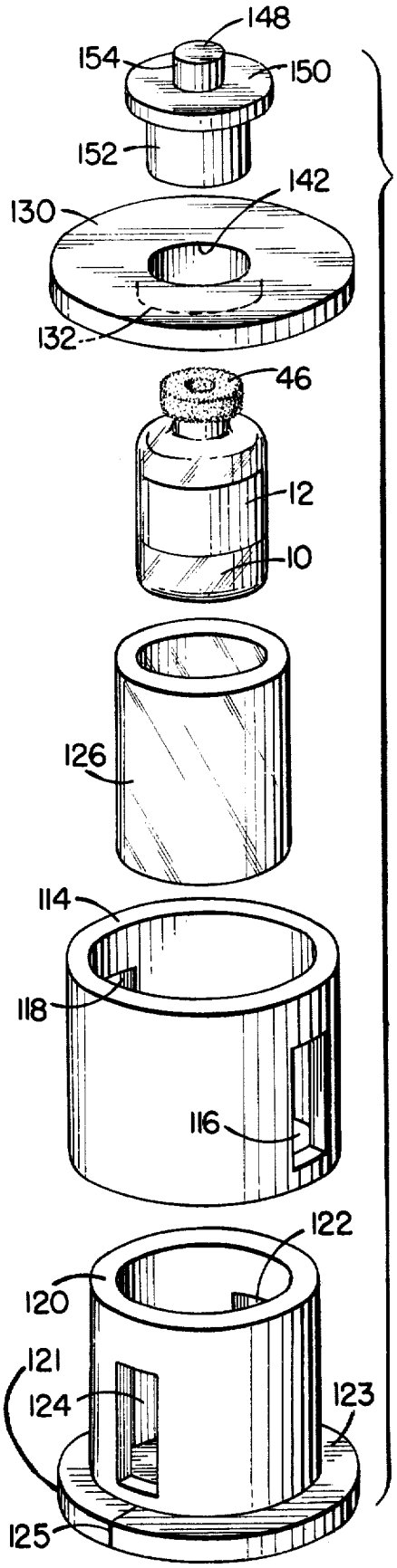
FIG.4
FIG.5
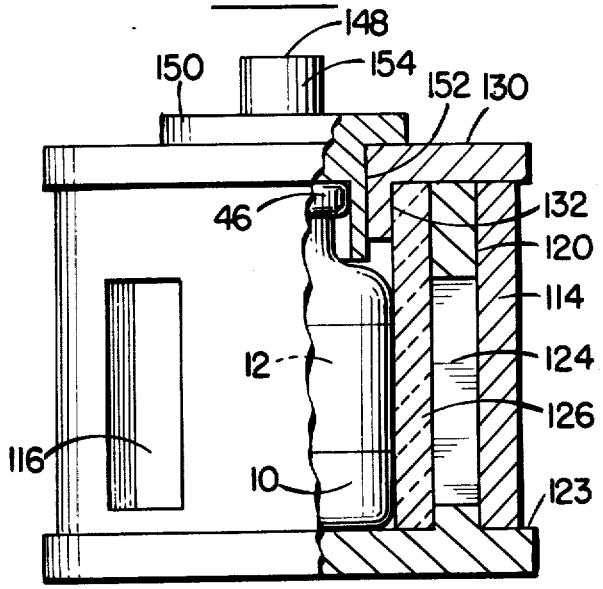

RECEPTACLE FOR RADIOACTIVE MATERIAL

REFERENCE TO OTHER APPLICATIONS

This application is a continuation-in-part of copending application Ser. No. 333,095, filed Feb. 16, 1973, now abandoned.

BACKGROUND OF THE INVENTION

The present invention relates to a receptacle for a radioactive material container.

The use of medicinal grade radioactive solutions such as containing $Tc^{99m}$ is undergoing great expansion. A critical problem has arisen along with the increased use of these solutions. It is generally agreed that excessive exposure to even low level emission is highly undesirable as evidenced by the fact that there are federal regulations defining permissible exposure. In 10 CFR Part 20 there is defined the exposure level permissible. Accordingly, most generative and storage systems include protective shielding to bar the passage of emitted radiation. There are various devices now in use which provide adequate protection from radiation. It is, however, necessary that the fluid or material level be easily viewed so that it can be ascertained if there is sufficient fluid for the next application. In other words, it is highly undesirable for one to have to remove the container from its protective shielding merely to ascertain the fluid level thereof. This would result in unnecessary emission exposure which, according to the present invention, can be easily avoided.

The primary method of detecting the material level in a shielded container has been the provision of a viewing means, such as a window, made from such as leaded glass. There are a number of variations adapting this principle, such as those described in U.S. Pat. Nos. 3,286,095, 3,655,985, and 3,673,411. In U.S. Pat. No. 3,286,095 a box-like casing has a window comprising one side thereof, the interior of the casing always being in view. In U.S. Pat. No. 3,655,985 a lead casing includes a window which is filled with a transparent shielding material such as leaded glass. U.S. Pat. No. 3,673,411 incorporates an essentially similar window to that described in U.S. Pat. No. 3,655,985. All the foregoing patents have one common characteristic; at all times leaded glass or other transparent shielding material is exposed to the emissive contents and, more importantly, the viewer is always confronted by this shielding material. It is certainly accepted that a dense, non-transparent material such as lead has greater shielding characteristics than such as leaded glass. While the glass may provide sufficient shielding to maintain emissions under the mandated maximum, it is certainly worthwhile to reduce the exposure level under even that limit. Indeed, the optimum situation is to reduce exposure to zero, a level though not attainable, can be approached. The present invention is directed to reducing emission exposure as much as possible and well below the maximum permitted by law. In comparison to the devices thus described, it exhibits superior shielding characteristics and at the same time allows the material level to be simply ascertained.

SUMMARY OF THE INVENTION

The receptacle comprises three concentric cylindrical casings of radiation shielding material, a container of radioactive material being received within the innermost casing, and a cover member or members of radiation shielding material forming a closure for the casings which are open at the top. Two of the casings and the cover member or members are of non-transparent radiation shielding material, such as lead, and the third casing is of transparent radiation shielding material, such as leaded glass. The three casings are sized to fit one within the other in the particular order established by a specific embodiment of the invention, i.e., the casing of transparent radiation shielding material may be the innermost, or the intermediate, or the outermost casing of a specific embodiment. One of the non-transparent casings is movable with respect to the other non-transparent casing so that windows in each of the non-transparent casings can be aligned by the relative movement therebetween to permit the viewing of the material level within the container. The non-transparent casings each include a pair of windows which are generally rectangular and parallel to the axis of the cylinder. The windows of each casing are disposed at the ends of a diameter between the window centers. In normal use, the windows of the non-transparent casings are non-aligned so that maximum shielding material surrounds the container of radioactive material which is received in the innermost of the three casings. At times, it is desired to view the material level of the container. To accomplish this, one non-transparent casing is rotated with respect to the other non-transparent casing until the windows of the two casings are aligned. To provide adequate shielding against emission when the windows are aligned, the cylindrical casing of transparent radiation shielding material, such as leaded glass, is provided. After the fluid level in the container is ascertained, the casings are rotated with respect to each other until the windows are no longer aligned, thereby providing a compact, fully shielded closure for the container.

A cover, of shielding material such as lead, forms a closure for the three casings all of which are open at their tops. The cover includes a central opening which is normally filled by a lead tampon which is easily removed and inserted, and the tampon includes a flange by which it is supported on the cover. Since the radioactive material container generally has a pierceable cap, a hypodermic needle may be inserted into the container through the cap so as to withdraw fluid from the container. As soon as the needle is removed, the tampon is replaced in the opening in the cover thus barring emission therethrough.

The above and other aspects of the present invention will be apparent as the description continues, and when read in conjunction with the appended drawings.

DESCRIPTION OF THE DRAWINGS

FIG. 1 is an exploded perspective of the constituent elements of one embodiment of the present invention;

FIG. 2 is an elevational view of the embodiment of FIG. 1 with the windows aligned;

FIG. 3 is an elevational view, partially in section, of the embodiment of FIG. 1 showing the windows in a non-aligned position.

FIG. 4 is an exploded perspective of the constituent elements of another embodiment of the present invention; and FIG. 5 is an elevational view, partially in section, of the embodiment of FIG. 4 showing the windows in a non-aligned position.

DETAILED DESCRIPTION

FIG. 1 shows the details of various elements of one embodiment of the instant invention. The bottle or vial 10 contains a radioactive fluid 12 that may be used in a variety of medical applications. The fluid 12 is emissive; unnecessary exposure to the emitted radiation is to be avoided and the vial 10 must be adequately shielded. Accordingly, the vial 10 is contained within an inner casing 14 which is fabricated from lead or other acceptable shielding material. The inner casing 14 is generally cylindrical, is open at its top and closed at its bottom.

Situate at the respective ends of a diameter of the cylinder are two slots or windows 16, 18. Those windows are generally parallel to the axis of the casing 14 and terminate slightly below the top and slightly above the bottom thereof. At all times the vial 10 is enclosed within the inner casing 14. It is through those windows that the vial 10 can be viewed, which viewing is necessary to quickly and safely ascertain the fluid level thereof.

Obviously, since the inner casing 14 includes open windows, it is necessary to provide additional shielding from the emitted radiation which can escape through those windows. This additional shielding is accomplished by means of the outer casing 20 which is identical to the inner casing 14 except that it is sized slightly larger so as to house the inner casing. It is open at its top and closed at its bottom and includes windows 22, 24 similar to, and slightly larger than the windows 16, 18, the windows 22, 24 being situate at the opposite ends of a diameter of the outer casing. The windows 22, 24 are slightly larger than windows 16, 18 so that windows 16, 18 are in full view when the two sets of windows are aligned. In this manner it is possible to see into the interior of casing 14 to ascertain the fluid level of container 10. It should be clear that the use of two windows in each casing performs a dual function: firstly, they provide two positions of window alignment; secondly, they permit more light to pass into casing 14 to facilitate viewing.

When it is desired to merely store the container 10 with maximum shielding, the windows are non-aligned so that there is no direct escape route for emission from the material 12. When the windows are aligned, however, the unacceptable situation exists where there is a direct escape route for the emitted radiation through those windows. Accordingly, an intermediate shield member 26, fabricated from transparent shield material, such as leaded glass, is received between the inner 14 and outer 20 casings. That shield 26 is cylindrical in shape, sized slightly smaller than the outer casing 20, and slightly larger than the inner casing 14, and it is open at the top and bottom. Not only does this leaded glass shield 26 contribute to the over-all shielding characteristics of the receptacle when the windows are non-aligned, but it provides the only shielding when the windows are aligned. The shield 26 remains stationary relative to the outer casing 20, and permits the inner casing 14 to rotate therewithin.

The three shields thus far described provide adequate shielding in all directions except directly above the receptacle. Shielding in this direction is provided by the cover 30, which may be fabricated from lead, and which seals the open tops of the casings 14, 20, 26. The cover 30 includes the plug section 32 which is of slightly smaller diameter than the inner casing 14 and is received in that inner casing. That plug 32 includes the projections 34, 36 which extend radially outwardly therefrom and which are received in the slots 38, which are formed at the ends of a diameter, in the walls of the inner casing 14. This arrangement permits the rotation of the inner casing 14 to be actuated by the rotation of the cover 30. The projections 34, 36 drive the inner casing, while at the same time, the outer casing remains stationary. When it is desired to view the interior of the inner casing 14, the cover 30 is rotated until the windows 16, 18, 22, 24 are aligned. A further utility of the cover 30 is indicated by the pointers 40. Those pointers, and the projections 34, 36 are positioned such that the pointers are always vertically aligned with the windows 16, 18 of the inner casing 14. In this manner, the position of the windows 16, 18 is always known even though the windows may not be aligned.

In another embodiment of this invention, as illustrated in FIGS. 4 and 5, the three concentric cylindrical casings are arranged with the transparent casing 126, fabricated from leaded glass or other acceptable transparent radiation shielding material, as the innermost casing with the vial 10 of radioactive fluid 12 contained therein. The transparent casing 126 is cylindrical and is open at its top and bottom.

The transparent casing 126 is sized to fit into the cylindrical casing 120 and be retained therein by the closed bottom 121. Casing 120 is fabricated of a non-transparent radiation shielding material, such as lead, and includes viewing slots or windows 122 and 124 which are situated at opposite ends of a diameter of the cylindrical casing 120, i.e., opposite each other.

A second casing 114 of non-transparent radiation shielding material, such as lead, is sized to fit outside the casing 120, is open at its top and bottom, and is retained on the outwardly extending flange 123 of the bottom 121 of casing 120. This casing 114 is provided with oppositely disposed viewing slots or windows 116, 118 which are the same size or slightly larger than the windows 122 and 124 in the casing 120 to permit viewing of the material level in vial 10 when the windows are aligned.

To assist in alignment of the windows 116, 118 and 122, 124 of the casings 114 and 120, the bottom 121 of the casing 120 has a mark 125 on its outer edge to indicate the position of window 124 and an identical mark (not shown) to indicate the position of window 122. When it is desired to align the windows 116, 118 and 122, 124, the casing 114 is simply rotated on the flange 123 to place one of the windows 116 or 118 at the mark 125 or the other mark (not shown).

The cover 130 is fabricated of non-transparent radiation shielding material, such as lead, and is sized to cover the tops of all three casings 126, 114 and 120 with the plug 132 fitting into the casing 126 to hold the cover in place.

It is desirable for a physician to be able to withdraw the radioactive fluid from the container 10 without completely removing the same from the innermost casing 14 or 126. To this end, the cover 30 or 130 is provided with a a central opening 42 or 142 which extends completely through the plug 32 or 132 thus permitting direct access into the interior of casing 14 or 126. As shown in FIG. 2, when it is desired to withdraw the radioactive fluid 12, a hypodermic needle 44 is simply inserted through hole 42 or 142 and pierces the cap 46. Upon removal of the hypodermic needle 44 a tampon 48 or 148 is close fittedly received in the opening 42 or 142. The tampon 48 or 148 is fabricated from lead and includes the cylindrical flange 50 or 150 which normally rests on the cover 30 or 130 but is not in any way fixed thereto and may be removed at will. The tampon 48 or 148 includes the bottom or plug section 52 or 152 which effectively bars radiation leakage through opening 42 or 142, and includes the handle section 54 or 154 which permits the user to simply grasp the tampon for removal and insertion.

It has been seen that the receptacle described and illustrated herein provides an extremely effective shield against emission from the radioactive fluid, but at the same time, permits viewing of the fluid level, or other visual characteristic of the fluid, without unnecessarily exposing anyone to excessive radiation. One of the unique features of this receptacle is that the various components may be used individually for low level activity, or may be combined where the fluid is characterized by high levels of radioactivity. For instance, assuming the fluid 12 emits 200 micro-Curies such as would be the emission from $Tc^{99m}$, radiation readings taken at the surface and at one foot and two feet from the various combinations of components are all within acceptable limits. In this test, using a receptable as shown in FIGS. 1–3, the inner casing was 1/16 inch thick, the intermediate casing ¼ inch thick, and the outer casing 5/32 inch thick.

Many changes may be made in the details of the instant invention, in the method and materials of fabrication, in the configuration and assemblage of the constituent elements, without departing from the spirit and scope of the appended claims, which changes are intended to be embraced therewithin.

What is claimed is:

1. A receptable for storing a radioactive material container comprising an outer casing of radiation shielding material, an intermediate casing of radiation shielding material, an inner casing of radiation shielding material, said radioactive material container situate in said inner casing, two of said casings being of non-transparent radiation shielding material and the third said casing being of transparent radiation shielding material, and means effective to move one of said non-transparent casings with respect to said other non-transparent casing, said non-transparent casings each including viewing means which can be aligned by relative movement of said non-transparent casings to establish a view path into the interior of said inner casing to perceive radioactive material in said container.

2. A receptacle for storing a radioactive material container comprising an outer casing of non-transparent radiation shielding material, an inner casing of non-transparent radiation shielding material, said radioactive material container situate in said inner casing, an intermediate casing of transparent radiation shielding material received between said inner and outer casings, and means effective to move one of said outer or inner casings with respect to said other, said outer and inner casings each including viewing means which can be aligned by relative movement of said casings to establish a view path into the interior of said inner casing to perceive radioactive material in said container.

3. The receptacle of claim 2 including cover means, said casings being open at their tops and said cover means forming a closure therefor, said cover means being connectable to and effective to move one of said outer or inner casings with respect to said other.

4. A receptable for storing a radioactive material container comprising an outer casing of non-transparent radiation shielding material, an intermediate casing of non-transparent radiation shielding material, an inner casing of transparent radiation shielding material, said radioactive material container situate in said inner casing, and means effective to move said outer casing with respect to said intermediate casing, said outer and intermediate casings each including viewing means which can be aligned by relative movement of said outer and intermediate casings to establish a view path into the interior of said inner casing to perceive radioactive material in said container.

5. The receptacle of claim 4 wherein said viewing means comprises windows in said casings, said windows being parallel to said casings' axes.

6. The receptacle of claim 4 wherein said non-transparent casings are fabricated from lead.

7. The receptacle of claim 4 wherein said inner casing is fabricated from leaded glass.

8. The receptacle of claim 4 wherein said outer, intermediate and inner casings are concentric cylinders.

9. The receptacle of claim 4 wherein said outer, intermediate and inner casings are concentric cylinders, and said viewing means comprises a pair of windows in each of said outer and intermediate casings, said windows being generally rectangular and elongated parallel to said cylinders' axes with said pair of windows in each of said casings disposed at opposite ends of a casing diameter.

10. The receptacle of claim 4 including cover means, said casings being open at their tops and said cover means forming a closure therefor.

11. The receptacle of claim 10 wherein said cover includes a central opening, and a tampon is provided for said opening to form a closure therefor, said tampon being fabricated from non-transparent shielding material.

* * * * *